United States Patent [19]

Russo

[11] 3,986,144

[45] Oct. 12, 1976

[54] OSCILLATOR WITH BLINKING LIGHT EMITTING DIODE FOR ORNAMENTAL RING

[76] Inventor: Joseph Russo, Hotel George Washington, 23 St. and Lexington Ave., New York, N.Y. 10010

[22] Filed: June 16, 1975

[21] Appl. No.: 587,251

[52] U.S. Cl. ..... 331/111; 63/15; 240/6.4 W; 240/59; 250/552; 315/200 A; 315/238; 315/241 R; 331/113 R; 340/331

[51] Int. Cl.[2] ..... F21V 33/00; H05B 37/02; A44C 9/00

[58] Field of Search ..... 331/111, 113 R; 315/200 R, 200 A, 238, 241 R; 340/331; 250/552, 553; 63/15; 240/6.4 W, 59

[56] References Cited

UNITED STATES PATENTS

| | | | |
|---|---|---|---|
| 3,240,989 | 3/1966 | Grunwaldt | 331/113 R X |
| 3,696,311 | 10/1972 | Oushige et al. | 331/113 R |
| 3,803,515 | 4/1974 | Carlson | 315/200 A X |
| 3,901,121 | 8/1975 | Kleiner | 340/331 X |

*Primary Examiner*—Siegfried H. Grimm
*Attorney, Agent, or Firm*—Philip Sands

[57] ABSTRACT

An ornamental ring having a flashing capacity controlled by a minute electrical circuit incorporating one or more light-emitting diodes which are confined in the gem-display region of the ring, is disclosed. A time delay, capacitor-resistor arrangement governs the activation and deactivation of a pair of transistors whose function is to cause the light-emitting diodes to alternately flash or blink in substantially identical intervals.

11 Claims, 5 Drawing Figures

OSCILLATOR WITH BLINKING LIGHT EMITTING DIODE FOR ORNAMENTAL RING

BACKGROUND OF THE INVENTION

The present invention relates generally to ornamental articles, and more particularly to a minute electrical circuit for disposition in an ornamental article, for example, a ring, to control a blinking or flashing light.

Light-emitting diodes have been found to be highly useful in various devices and, as suggested in U.S. Pat. No. 3,737,731 issued on June 5, 1973, have utility in ornamental articles such as jewelry, in the form of tie-clasps or earrings and the like. In the aforementioned patent, electrical circuitry governs the flashing or blinking rate of a light-emitting diode, the circuitry including at least three different transistors and six different resistors all operatively associated with a charging-and-discharging capacitor. The electrical arrangement of the transistors and resistors is such that the period of time in which the light-emitting diode emits light differs substantially from the period of time in which the light-emitting diode ceases to emit light. In other words, the circuit arrangement in the aforementioned patent is not a "balanced" circuit to provide for alternate periods of identical duration in which the light-emitting diode emits ligth and ceases to emit light.

Moreover, the great number of resistors and the excessive number of transistors in the circuit of the aforementioned patent makes the circuit substantially larger than it need be, and as a result interferes with the ready disposition of such a circuit in a minute portion of an ornamental article in the form of a tie-clasp or earrings. As a result, any ornamental article in which such a circuit is incorporated would be heavier and more bulky than it need be, and thus uncomfortable and possibly even unnecessarily gaudy. The present invention may, therefore, be characterized as an improvement over the electrical circuitry disclosed in the aforementioned patent.

SUMMARY OF THE INVENTION

Accordingly, it is an object of the present invention to provide an electrical circuit of minute size having a minimum number of electrical components associated with one or more light-emitting diodes, whereby, without resorting to a "printed circuit" mode, the size and bulk of any ornamental article incorporating such circuit are not unnecessary increased.

It is a further object of the present invention to provide an electrical circuit in which the electrical components are so arranged that the circuit is "balanced," whereby there are provided alternate periods of identical duration in which the light-emitting diode(or diodes) emits light and ceases to emit light.

The invention may thus be characterized as an electrical circuit for an ornamental article, the circuit comprising a light-emitting diode (or diodes), only a single pair of gate-acting elements electrically coupled with one another and with the light-emitting diode, and a time delay system electrically coupled with a first of the gate-acting elements for alternately rendering the first gate-acting element conductive and non-conductive. The light-emitting diode is electrically coupled with the second of the gate-acting elements such that the latter is alternately conductive and non-conductive 180° out of phase with the conductive and non-conductive periods of the first gate-acting element such that, upon conduction of the latter, the light-emitting diode operates to emit light and render non-conductive the second gate-acting element and, upon non-conductive of the first gate-acting element, the light-emitting diode ceases to emit light but renders conductive the second gate-acting element. The second gate-acting element is electrically coupled with the time delay system such that, during the period in which the second gate-acting element is conductive, the time delay system operates to delay the conduction of the first gate-acting element.

In the preferred form of the present invention, the gate-acting elements are silicon NPN transistors, whereas the time delay system is in the form of a resistor-capacitor circuit coupled with the transistors and the light-emitting diode.

Moreover, in the preferred form of the ornamental article incorporating the electrical circuit of the present invention, the ornamental article is a ring for disposition on a wearer's finger, and includes, preferably, though not necessarily, a touch-sensitive electronic switch, having no moving parts, which is responsive to conduct electrical current simply when touched lightly by the finger-tip of a human being. The switch preferably is disposed along the outer surface of the ring at a location accessible to the tip of the wearer's thumb, whereby when a wearer decides to display the flashing or blinking capacity of the ring, he need merely touch his thumb-tip to the switch, the latter in turn closing the circuit and effecting blinking of the light-emitting diode for as long as the thumb-tip remains in contact with the switch.

BRIEF DESCRIPTION OF THE DRAWINGS

The above and additional objects and advantages of the present invention will be more clearly understood from the following detailed description thereof when read in conjunction with the accompanying drawings, in which.

DETAILED DESCRIPTION OF THE INVENTION

Figure 1:
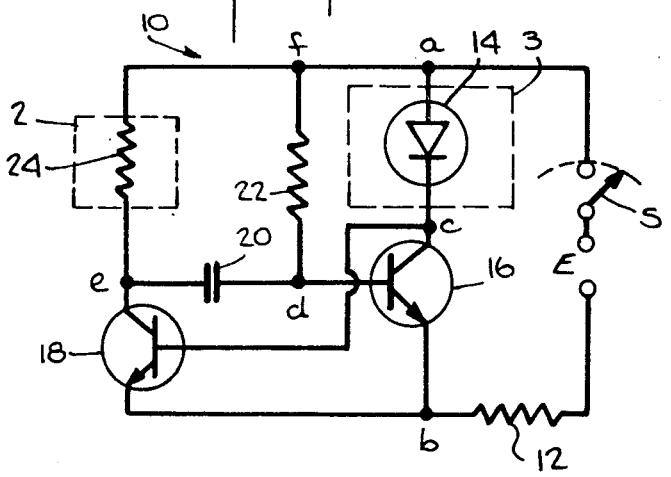
FIG. 1 is a schematic illustration of one embodiment of the electrical circuit of the present invention.

Referring now to the drawings, and more particularly to FIG. 1, there is illustrated a minute electrical circuit denoted generally by the reference character 10. The circuit 10 includes, for example, a direct current power source or battery E which is electrically coupled with a switch S shown in an open position. Coupled in series with the battery E is a resistor 12, the resistor 12 cooperating with the battery E and the switch S across the terminals *a* and *b* for governing the power output to the remainder of the circuit 10.

The source of the blinking or flashing light of the present invention is a conventional light-emitting diode 14 having an anode disposed at the junction *a* and a cathode disposed at a junction *c* between the junctions *a* and *b*. The cathode of the light-emitting diode 14 is coupled electrically with the collector of a first transistor 16 and the base of a second transistor 18. The emitter of the transistor 16 is electrically coupled with the emitter of the transistor 18, for example at junction *b*. It will be understood that the transistors 16 and 18 may be characterized as gate-acting elements which may be alternately triggered for controlling the flashing or blinking capacity of the light-emitting diode 14.

The gate-acting elements or transistors 16 and 18 are controlled by a time delay means in the form of, for example, a resistor-capacitor circuit which varies the power output to the transistor 16, such that the latter when activated causes the light-emitting diode 14 to light and when deactivated causes the light emitting diode 14 to cease emitting light.

In this respect, the resistance-capacitor circuit aforementioned includes a capacitor 20 and a resistor 22 electrically coupled to one another at junction *d*, the capacitor 20 and resistor 22 also being electrically coupled to one another through the intermediary of an additional resistor 24, via the junctions *e* and *f*. As can be seen in FIG. 1, the junction *d* between the capacitor 20 and resistor 22 is electrically coupled to the base of the transistor 16, whereas the junction *e* between the capacitor 20 and resistor 24 is electrically coupled to the collector of the transistor 18. Moreover, the junction *f* to one side of the resistor 22 is electrically coupled with the anode of the light-emitting diode 14 at the junction *a*.

As is clear, when sufficient current is directed to the base of the transistor 16, the latter becomes activated, thereby triggering the light-emitting diode 14 to light. Similarly, when insufficient current is directed to the base of the transistor 16, the latter effectively deactivates the light-emitting diode 14 and prevents the latter from emitting light. Thus, the very heart of the activation and deactivation of the lighting capacity of the light-emitting diode 14 is controlled by the base of the transistor 16. However, it is the time delay means of the cooperating capacitor 20 and resistor 22 which effectively governs the sufficiency and insufficiency of current feed to the base of the transistor 16.

In this respect, when the switch S is closed, the current is passed from the junction *c* of the light-emitting diode 14 to the base of the transistor 18. Moreover, the capacitor 20 begins to charge as the transistor 18 directs current from the emitter thereof to the resistor 12 and ultimately back to the battery E. During the time it takes for the capacitor 20 to fully charge itself, insufficient current is directed to the base of the transistor 16 and, therefore, the light-emitting diode 14 is prevented from lighting. However, once the capacitor 20 has fully charged itself, sufficient current is immediately directed to the base of the transistor 16 to enable the latter to pass current from the collector to the emitter thereof, and thence to the resistor 12 and battery E. As a result, the light-emitting diode 14 lights for the period of time that it takes for the capacitor 20 to discharge completely. Once the capacitor 20 has fully discharged itself, again there is an insufficient amount of current directed to the base of the transistor 16 and, therefore, the latter is deactivated, thereby, deactivating the light-emitting diode 14.

Accordingly, as the capacitor 20 charges and discharges alternately, the light-emitting diode 14 flashes on and off. It will be understood, that the resistor 24 between the terminals *e* and *f* may be in form of a second light-emitting diode, which because of its particular location will flash on and off alternately with the flashing of the light-emitting diode 14. In other words, when the light-emitting diode 14 emits light, the light emitting diode 24 would cease to emit light. Alternatively, when the light-emitting diode 14 ceases to emit light, the light-emitting diode 24 would emit light.

Figure 2:
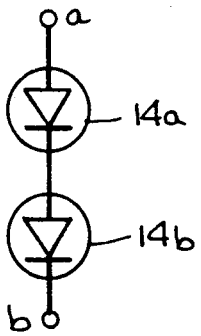
FIG. 2 is an alternate detailed embodiment of the box 2 shown in phantom in FIG. 1.
Figure 3:
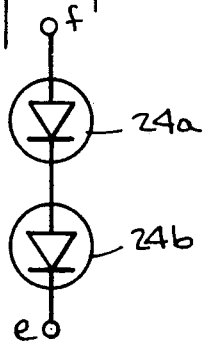
FIG. 3 is an alternate detailed embodiment of the box 3 shown in phantom in FIG. 1.
Figure 5:
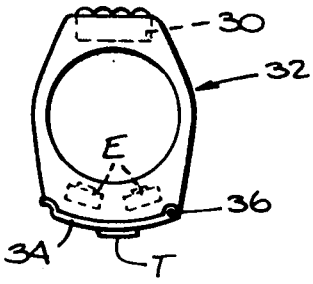
FIG. 5 is a schematic illustration of an ornamental ring in which the electrical circuit of the present invention is disposed.

Moreover, as illustrated in FIGS. 2 and 3, respectively, the light-emitting diode 14 may be replaced by a pair of light-emitting diodes 14*a* and 14*b*, whereas the resistor 24 in the form of a single light-emitting diode in FIG. 1 may be replaced by a similar pair of light-emitting diodes 24*a* and 24*b*. In the embodiments of FIGS. 2 and 3, the light-emitting diodes 14*a* and 14*b* are connected in series with one another, and similarly the light-emitting diodes 24*a* and 24*b* are electrically connected in series with one another. Thus, the light-emitting diodes 14*a* and 14*b* would light as a pair simultaneously with one another during the period in which the light-emitting diodes 24*a* and 24*b* cease to emit light. Similarly, the light-emitting diodes 24*a* and 24*b* would simultaneously light as a pair during the period in which the light-emitting diodes 14*a* and 14*b* cease to emit light.

Figure 4:
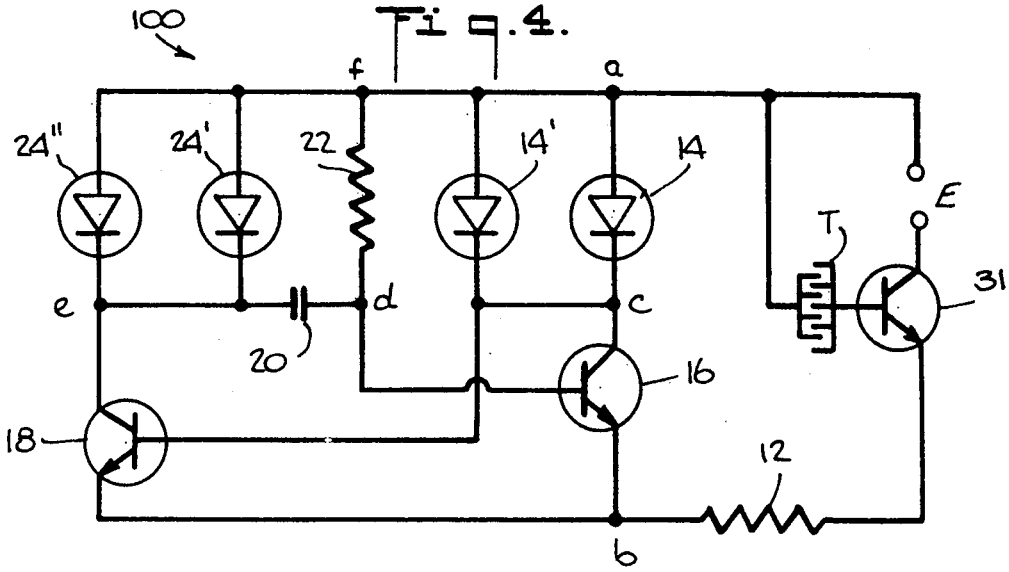
FIG. 4 illustrates an alternate embodiment of the electrical circuit pursuant to the present invention including the preferred form of the touch-sensitive switch.

Still a further embodiment of the present invention is illustrated in FIG. 4 and generally denoted by the reference character 100. Certain components of the embodiment 100 in FIG. 4 are identically arranged with and identical to corresponding components in FIG. 10 and, therefore, the corresponding components of FIGS. 1 and 4 have like reference characters. The basic distinction between embodiments of FIGS. 1 and 4 is that in FIG. 4 the light-emitting diode 14 has a mate in the form of a light-emitting diode 14', which light-emitting diodes 14 and 14' are electrically coupled in parallel with one another. Moreover, the resistor 24 of FIG. 1 is replaced in FIG. 4 by a pair of light-emitting diodes 24' and 24'' which are electrically coupled in parallel with one another.

Because of the parallel pairing of the light-emitting diodes 14 and 14° and their association with the parallel pairing of the light-emitting diode 24' and 24'', when the transistor 16 is activated by the fully charged and discharging capacitor 20, the light-emitting diodes 14 and 14' in tandem simultaneously emit light whereas the light-emitting diodes 24' and 24'' do not emit light. However, once the capacitor 20 is fully discharged, and the transistor 16 is deactivated, the transistor 18 is activated, thereby causing the tandem pair of light-emitting diodes 24' and 24'' to emit light and preventing the light-emitting diodes 14 and 14' from emitting light. Thus, the diodes 14 and 14' blink as a pair alternately with the blinking as a pair of the diodes 24' and 24''.

Because of the particular arrangement of the electrical components of the circuitry of the present invention, the single light-emitting diode 14 illustrated in FIG. 1 alternately emits light and ceases to emit light for periods of identical duration. In the instance in FIG. 1 where the resistor 24 is replaced by a light-emitting diode identical to the diode 14, the diode 14 and the diode 24 would each blink alternately with one another and also for periods of identical duration. The same is true with the tandem series pair of diodes 14*a* and 14*b* in FIG. 2 and the tandem series pair of diodes 24*a* and 24*b* in FIG. 3. This is furthermore true with respect to the tandem parallel diodes 14 and 14' in FIG. 4 and the tandem parallel diodes 24' and 24''. In each and every instance of the embodiments of the present invention, the on-off electric light-emitting intervals of the one or more diodes are of substantially identical duration.

For purposes of emphasis, at least insofar as FIG. 4 is concerned, it is preferred that the blinking rate of the diodes be in a range of approximately 100–200 flashes per minute. This is controlled by the parameter of the capacitor 20 which is preferably 4 microfarads, by the parameter of the resistor 22 which is preferably 270,000 ohms, by the parameter of the resistor 12 which is preferably in a range of 200–800 ohms, and by the parameter of the battery E which is approximately 3 volts. The remaining electrical components have parameter-values readily determinable in the light of the preferred component ratings aforementioned, preferably the resistance or impedance of the resistor 24 being substantially identical to the resistance impedance offered by the diode 14.

The electrical circuitry of the present invention is minute and thus, without resorting to a printed circuit mode, can be easily stored and confined in the gem-display cavity 30 of a ring 32. The switch S is diametrically opposite the cavity 30 and may have conventional moving parts for opening and closing the circuit. The switch S may also be in the form, as is preferred herein, of the type which is touch-sensitive in that it is provided with no moving parts and simply responds to the resistance of the skin of a human being wearing the ring 32.

Such a switch is shown at T in FIG. 4 and can be used likewise with the embodiments of FIGS. 1–3. The switch T has a pair of spaced, interfitting, toothed electrodes one of which is coupled with the base of a transistor 31, the other of which electrodes is coupled with the anode of the diode 14 at the junction *a* and with the collector of the transistor 31 through the intermediary of the battery E. The emitter of the transistor 31 is coupled with the resistor 12. The electrodes may also be a conductive wire tip projecting through and insulated from a conductive annulus.

In order to activate the electrical circuitry, all the wearer of the ring 32 need do is touch the tip of his thumb to the switch T to bridge the gap between the electrodes and cause one or more of the light-emitting diodes of the ring 32 to blink. It is clear that other touch-sensitive switches may be used likewise and electrically coupled with the circuit of the present invention in a manner well known in the art. However, the instant touch-sensitive switching arrangement has been found to be simple and effective, and requires little space.

Furthermore, the switch S (or T) may be mounted on a pivotal member or flap 34 hinged at 36 to ring 32. The flap 34 may be snap-shut and conceals a recess in the ring 32 in which is confined the battery (or batteries) E. Appropriate leads (not shown) are disposed in the recess concealed by the flap 34 and electrically couple the battery E and the switch S (or T) with each other and intercommunicate the gem-display cavity 30 with the recess in which is confined the battery E. The battery E, therefore, is readily accessible and easily interchangeable.

It will be understood that the foregoing description of the preferred embodiments of the present invention is for purposes of illustration only, and that the various structural and operational features and relationships herein disclosed are susceptable to a number of modifications and changes none of which entails any departure from the spirit and scope of the present invention as defined in the hereto appended claims.

What is claimed is:

1. Electrical circuitry comprising: a light-emitting diode; a pair of gate-acting elements electrically coupled with one another and with said light-emitting diode; time delay means electrically coupled with said light-emitting diode and said gate-acting elements for rendering said gate-acting elements alternately conductive and non-conductive 180° out of phase with one another such that when one of said gate-acting elements is conductive the other is non-conductive, said light-emitting diode being electrically coupled with said gate-acting elements such that when one of said gate-acting elements is conductive the other is non-conductive and said light-emitting diode emits no light, and when said one of said gate-acting elements is non-conductive the other is conductive and said light-emitting diode emits light; and touch-sensitive switching means having no moving actuating parts and electrically coupled with said light-emitting diode for energizing the latter.

2. Electrical circuitry as claimed in claim 1, wherein said touch-sensitive switching means includes a pair of closely spaced electrodes electrically insulated from one another, and a third gate-acting element, a first of said electrodes being electrically coupled with said light-emitting diode, the other of said electrodes being electrically coupled with said third gate-acting element, said third gate-acting element being electrically coupled with said pair of gate-acting elements.

3. Electrical circuitry as claimed in claim 2, wherein said first and second gate-acting elements are each transistors having a respective base, a respective collector and a respective emitter, said time delay means including a capacitor and a resistor coupled with one another and between them with the base of said first gate-acting element, said capacitor including a first plate coupled with said resistor and a second plate coupled with the collector of said second gate-acting element, the emitters of said transistors being coupled with one another, said light-emitting diode having an anode terminal coupled with said resistor and a cathode terminal coupled both with the base of said second gate-acting element and the collector of said first gate-acting element.

4. Electrical circuitry as claimed in claim 3, including resistor means coupled with said second plate of said capacitor, with the collector of said second gate-acting element and with said resistor, said resistor means having substantially the same impedance as said light-emitting diode.

5. Electrical circuitry as claimed in claim 4, wherein said resistor means is a second light-emitting diode which blinks alternately with said first light-emitting diode.

6. Electrical circuitry as claimed in claim 5, including a third light-emitting diode coupled in parallel with said first light-emitting diode, and a fourth light-emitting diode coupled in parallel with said second light-emitting diode.

7. Electrical circuitry as claimed in claim 5, including a third light-emitting diode coupled in series with said first light-emitting diode, and a fourth light-emitting diode coupled in series with said second light-emitting diode.

8. Electrical circuitry as claimed in claim 1, wherein said time delay means is balanced to impart to said light-emitting diode alternate periods of substantially identical duration in which said diode emits light and ceases to emit light.

9. Electrical circuitry as claimed in claim 2, including a housing in which is confined and displayed said light-emitting diode, said housing being substantially an annular body and having an exposed cavity in the body thereof in which is confined at least said diode.

10. Electrical circuitry as claimed in claim 9, wherein said switching means is substantially 180° opposite said cavity and disposed on the outer surface of said annular body.

11. Electrical circuitry as claimed in claim 3, including a further resistor interconnecting said first and third gate-acting elements, and battery means interconnecting the first said electrode and said third gate-acting element.

* * * * *